US007172151B2

(12) United States Patent
Biagiotti et al.

(10) Patent No.: US 7,172,151 B2
(45) Date of Patent: Feb. 6, 2007

(54) REWINDING MACHINE FOR PRODUCING LOGS OF WOUND WEB MATERIAL AND RELATIVE METHOD

(75) Inventors: GuglieLmo Biagiotti, Lucca (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 68 days.

(21) Appl. No.: 10/520,813

(22) PCT Filed: Jul. 2, 2003

(86) PCT No.: PCT/IT03/00416

§ 371 (c)(1),
(2), (4) Date: Feb. 1, 2005

(87) PCT Pub. No.: WO2004/005172

PCT Pub. Date: Jan. 15, 2004

(65) Prior Publication Data

US 2006/0011767 A1 Jan. 19, 2006

(30) Foreign Application Priority Data

Jul. 9, 2002 (IT) ..... FI2002A0122

(51) Int. Cl.
*B65H 35/10* (2006.01)
*B65H 19/26* (2006.01)
*B65H 19/28* (2006.01)

(52) U.S. Cl. ..... 242/521; 242/532.2

(58) Field of Classification Search ..... 242/526.1, 242/527.2, 532.2, 532.3, 527.3, 526.2, 526, 242/527, 521
See application file for complete search history.

(56) References Cited

U.S. PATENT DOCUMENTS

| | | | | |
|---|---|---|---|---|
| 4,487,377 | A | 12/1984 | Perini | |
| 4,611,638 | A * | 9/1986 | Matumura | 139/304 |
| 4,909,452 | A | 3/1990 | Hertel et al. | |
| 5,335,869 | A | 8/1994 | Yamaguchi et al. | |
| 5,542,622 | A * | 8/1996 | Biagiotti | 242/521 |
| 5,690,296 | A * | 11/1997 | Biagiotti | 242/521 |

(Continued)

FOREIGN PATENT DOCUMENTS

| | | |
|---|---|---|
| IT | MI951174 | 12/1996 |

(Continued)

*Primary Examiner*—Kathy Matecki
*Assistant Examiner*—William E. Dondero
(74) *Attorney, Agent, or Firm*—Breiner & Breiner, LLC

(57) ABSTRACT

The rewinding machine includes: a first winding roller; a second winding roller; a nip defined between the first and the second winding rollers, through which the web material is fed; a roller surface, extending upstream of the nip in relation to the direction of feed of the web material and defining, with the first winding roller, a channel into which winding cores are fed; a feeder to feed winding cores into the channel; and a severing device to severe the web material upon termination of winding a log. The severing device is disposed to operate on the web material in a position upstream of an inlet end of the channel, in relation to the direction of feed of the web material and the first winding roller which has suction openings on its cylindrical surface. Moreover, between the position in which the severing device operates and the inlet of the channel, a suction box is provided inside the first winding roller.

8 Claims, 2 Drawing Sheets

U.S. PATENT DOCUMENTS 5,853,140 A 12/1998 Biagiotti
6,056,229 A * 5/2000 Blume et al. ..... 242/521
6,308,909 B1 * 10/2001 McNeil et al. ..... 242/527.4
6,494,398 B1 12/2002 De Matteis
6,497,383 B1 * 12/2002 Daul et al. ..... 242/521
6,595,458 B1 * 7/2003 Biagiotti ..... 242/532.2
6,945,491 B2 * 9/2005 Gambini ..... 242/521
2006/0076450 A1 * 4/2006 Gelli et al. ..... 242/526

FOREIGN PATENT DOCUMENTS

WO WO 94/21545 A1 9/1994
WO WO 00/68129 A1 11/2000

* cited by examiner

Fig.2
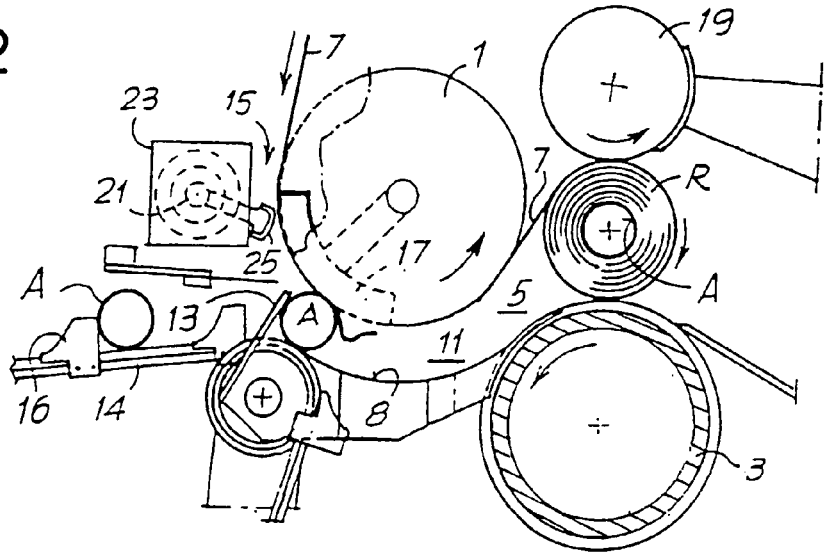
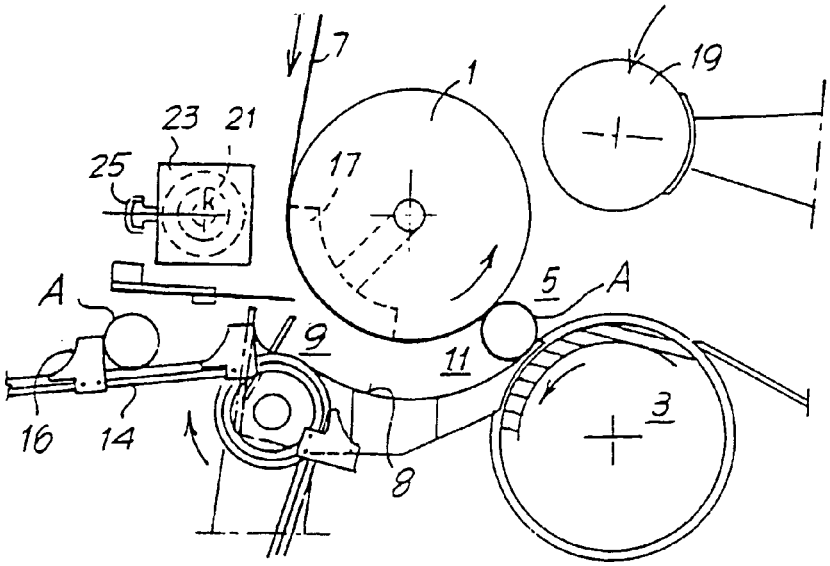
Fig.3
Fig.4
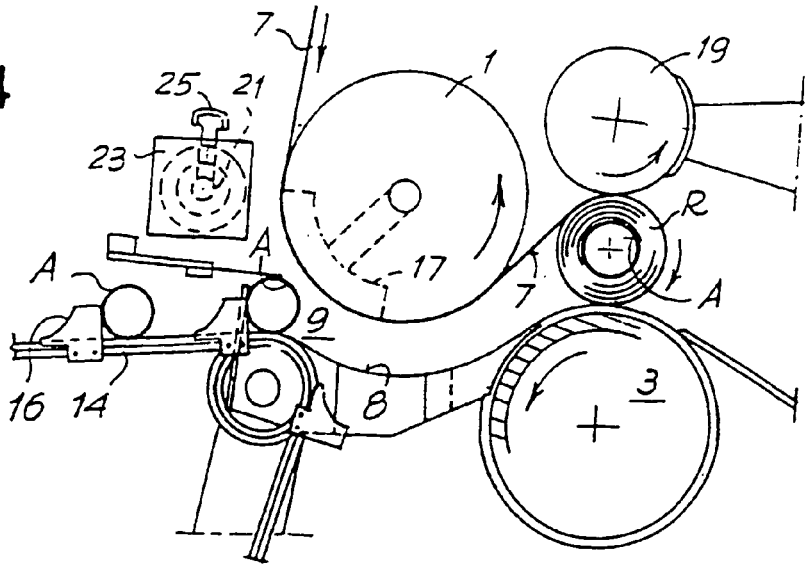

REWINDING MACHINE FOR PRODUCING LOGS OF WOUND WEB MATERIAL AND RELATIVE METHOD

TECHNICAL FIELD

The invention relates to a machine for forming rolls or logs of paper rolled on a tubular core in cardboard or the like. More specifically, the invention relates to a rewinding machine of the peripheral winding type, that is where a log of web material is formed in a winding cradle, in contact with the members that transmit rotary movement to the log being formed via friction on the external surface of the log.

STATE OF THE ART

The invention also relates to a method for producing logs of wound web material.

To produce rolls or logs of web material, for example in tissue paper to produce small rolls of toilet tissue, kitchen towels or the like, rewinding machines are used in which a predetermined quantity of web material is wound around tubular cores generally made of cardboard. These logs are then cut into a plurality of small rolls to be sold.

Winding machines are divided into two categories according to the system they adopt to supply rotary movement to the cores.

A first type of rewinding machine supplies the winding movement to the logs through a rotating support that is fitted inside the cores and made to rotate by a motor.

A second type of rewinding machine, called peripheral or surface rewinding machine, uses contact with the winding rollers which by rotating also determine rotation of the cores and their consequent winding movement. An example of this second type of rewinding machine is described in WO-A-9421545.

In particular, for this second type of rewinding machine, the phase in which the material between one log and the next is severed and a new log starts to be formed is particularly delicate; this involves dividing the web material to complete the preceding log and anchoring the initial edge to the new winding core.

U.S. Pat. No. 4,487,377 describes a system which cuts the web material with a blade upstream of the point at which a new core is fed and uses a suction system to maintain the edge adhering to the winding roller until this is brought into contact with the surface of the core spread with glue to start the winding, which is fed directly into the nip between a first and second winding cylinder.

WO-A-9421545 describes a system provided with a duct or channel to feed the core into the rewinding machine. This path also constitutes a rolling surface for the core and inside this, between a new winding core being fed and a log being completed, a severing device acts to create tension on the material and cause it to tear along a perforated line between the formed log and the new core.

Adhesion of the initial edge of the web material on the new core is guaranteed by glue applied to the surface of the core.

WO-A-00/68129 describes an analogous system to sever the web material and feed the new core into the winding zone. Adhesion on the new tubular core of the initial edge of the web material created by tearing is obtained by suction through the tubular core. Two suction ducts acting on the two ends of the core are provided for this purpose; these follow the core along the feed path and maintain the edge of the material adhering to the core by suction through the holes provided on the surface of the core, thus starting to wind the new log.

OBJECTS AND SUMMARY OF THE INVENTION

The object of the present invention is to produce a rewinding machine to form logs of wound web material, equipped with a device that allows the paper to be torn in a reliable way, offering high flexibility, simplifying and making it easier to feed new winding cores and reducing the number of mechanical parts in front of the nip between the winding rollers.

This and other objects and advantages, which shall become apparent to those skilled in the art by reading the text hereunder, are obtained in substance with an improved rewinding machine. This rewinding machine comprises: a first and a second winding roller which between them form a nip through which the web material to be wound on the cores is fed; a channel, positioned upstream of the nip between the first winding roller and the second winding roller, into which the tubular cores are fed to start winding the web material on the cores, constituted by a rolling surface for the cores; a core feed device to feed the cores into the inlet of the channel; a severing device to sever the web material at the end of winding a log and to form the initial edge of web material to start winding the subsequent log.

The severing device is disposed to operate on the web material in a position upstream of the inlet end of the channel into which the cores are fed, in relation to the direction of feed of the web material. Moreover, the surface of the first winding roller is provided with suction openings and between the position in which the severing device operates and the inlet to the channel a suction box is provided inside the first winding roller. This allows the initial and final edges of the web material produced by severing or tearing performed by the severing device to be held via the suction openings on the first winding roller to transfer the initial edge to a new core being fed into said channel.

Advantageously, the first winding roller may have a cylindrical surface with annular bands with a high friction coefficient and annular bands with a low friction coefficient; the severing device has a plurality of pressers positioned in relation to the first winding roller so that they press against it at the bands with a low friction coefficient.

In this way the severing device acts against the surface of the first winding roller to pinch the web material against it; the speed of the device is different and in particular lower than the peripheral speed of the roller and this causes tearing of the web material—which slips on the portions of smooth surface of the winding roller—downstream of the point in which the severing device acts.

As the web material is torn at one of the perforation lines produced on the material and which divide it into individual detachable portions, depending on the reciprocal distance between the perforation lines tearing may be performed in a position that is also upstream of the core around which the material is to be wound. It is thus necessary for the free end formed in this way to reach the core even if it is no longer under the tension of the web material preceding it. According to the invention the suction openings on the cylindrical surface of the first winding roller and the suction sector inside this roller are provide for this purpose. Although the web material is torn it does not cease to adhere to the first winding roller as it undergoes the suction action of on the portion of the roller inside which the suction sector is located. In this way the roller conveys the end of the web material to the point in which it comes into contact with a new core fed by the feed device. At this point winding of the web material onto the core commences with the suction action simultaneously stopping, as the end has moved beyond the suction portion of the roller.

The presence of the suction system is advantageous even if the machine processes materials in which the distance between the perforation lines causes tearing to occur downstream of the core insertion point, that is downstream of the point in which the core comes into contact with the web material driven around the winding roller. In this case, in fact, in the absence of suction on the surface of the roller synchronism between the severing action of the web material and feed of the winding core is extremely critical. In the absence of precise synchronization there is the risk that the new core will not pick up the initial free edge of the web material, causing the machine to stop. Suction on the surface of the winding roller makes it possible to guarantee correct transfer of the initial free edge to the new core even if movements are not perfectly synchronized.

Initial winding may be favored with methods known in the art. In particular, glues may be applied to the surface of the core in lines, rings or the like. When gluing takes place along a line parallel to the axis of the tubular core, it is advantageous for the core to be fed into the rewinding machine with an angular position that allows the core to accelerate angularly before the line of glue comes into contact with the web material.

Once the end of the web material has been anchored to the core, the first phase of the procedure to form the new log has commenced. At this point the log travels along the rolling surface at the end of which the first phase to form the log is completed. This surface may also be very limited in length. The procedure continues with completion of winding of the web material until reaching the desired final diameter. This completion takes place according to known methods such as those described in WO-A-9421545.

With a rewinding machine of the type described above a method for producing logs of web material as defined in claim 7 may be implemented.

Further advantageous characteristics and embodiments of the invention are indicated in the dependent claims.

BRIEF DESCRIPTION OF THE DRAWINGS

The invention shall now be better understood by following the description and attached drawing, which shows a non-limiting practical example of the finding, in which:

FIGS. 2–4 show a sequence of the operation of the rewinding machine.

DETAILED DESCRIPTION OF THE PREFERRED EMBODIMENT OF THE INVENTION

Figure 1:
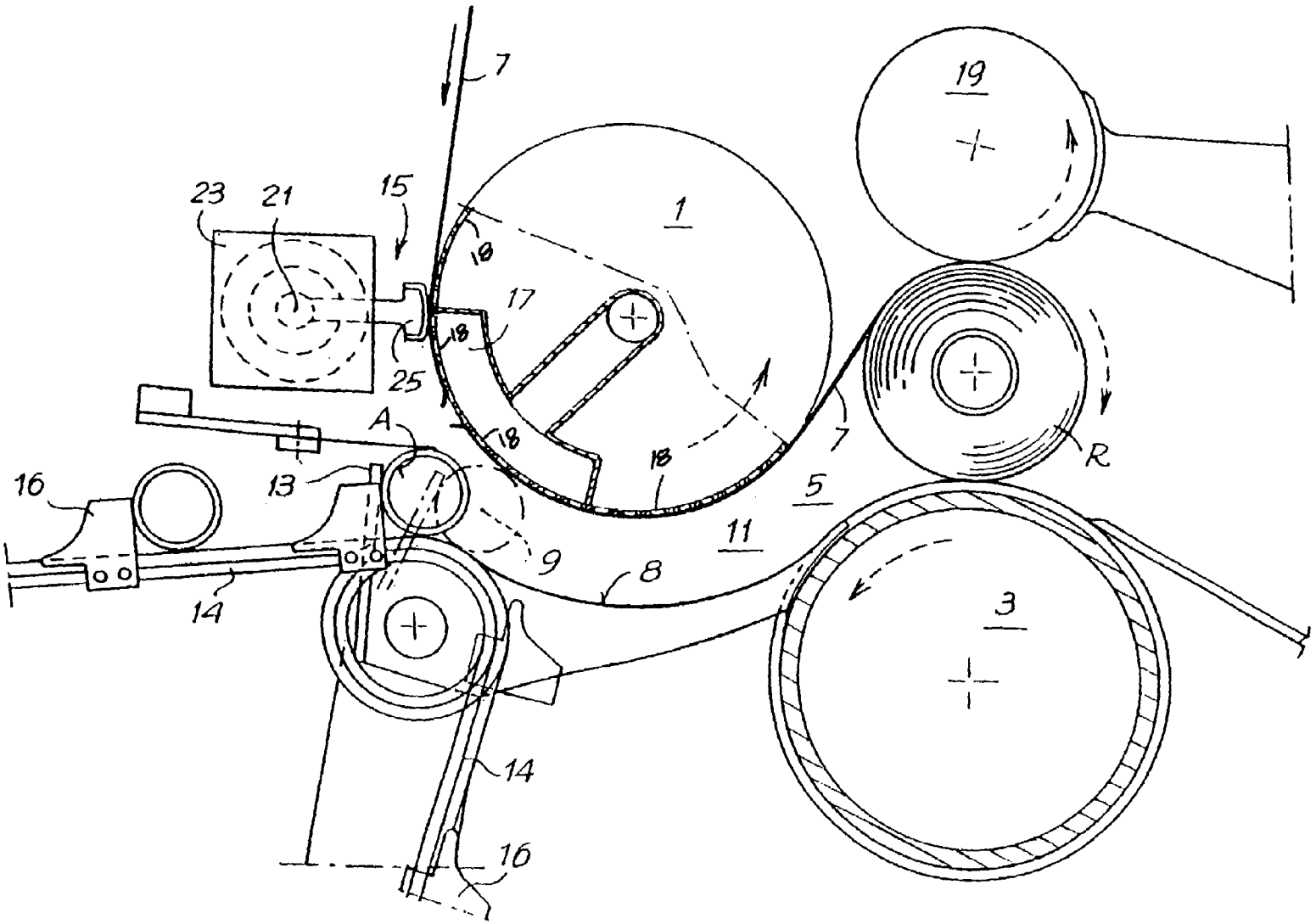
FIG. 1 shows a view of the rewinding machine according to the invention.

The rewinding machine according to the invention comprises a first winding roller 1; a second winding roller 3; a nip 5 defined between the two winding rollers, through which the web material 7 is fed; a rolling surface 8, which extends upstream of the nip 5 in relation to the direction of feed of the web material 7.

Defined between the first winding roller 1 and the rolling surface 8 is a channel for feeding the winding cores A. This channel has an inlet 9 and an outlet 11. Its dimension in height, that is the distance between the rolling surface 8 and the cylindrical surface of the roller 1, is more or less equal or slightly smaller than the diameter of the winding cores, which when inside the channel are in contact with both of these elements.

Also provided is a feeder 13 to feed the winding cores A into the channel. In the example shown, these are fed by a conveyor 14 along which pushers 16 are disposed. The conveyor 14 may pass through, in a per se known way, a glue dispenser to apply a glue to the surface of the cores A.

Upstream (in relation to the direction of feed of the web material) of the inlet end of the channel defined between the surface 8 and the roller 1 a severing device 15 is positioned to sever the web material 7 at the end of winding a log. Moreover, a third winding roller 19 with a movable axis is provided to complete winding the log in cooperation with the first and second winding roller 1 and 3.

As can be seen in FIG. 1, when the log R is completely formed the severing device 15 acts upstream of the inlet 9 of the feed channel. This severing device 15 rotates around an axis 21 moved by a motor 23 with a variable speed controlled by a programmable control unit, not shown, to act synchronously with the other elements of the machine.

The first winding roller 1 has a cylindrical surface with annular bands with a high friction coefficient alternated with annular bands with a low friction coefficient. The severing device 15 has a plurality of pressers 25 aligned parallel to the axis of rotation 21 and positioned in relation to the first winding roller 1 so that they press against it at the bands with a low friction coefficient.

The peripheral speed of the pads or pressers 25 of the severing device 15 is lower than the feed speed of the web material 7 and of the winding roller 1. Therefore, when the web material 7 is pinched between the winding roller 1 and the pads 25, the action of the severing device 15 tears the web material in a point between the pressure line of the pads 25 and the completed log, being unloaded from the winding cradle formed by the winding rollers 1, 3, 19. More specifically, tearing occurs along a perforation line, produced on the web material by a perforator unit, not shown.

The first winding roller 1 has suction openings 18 on its cylindrical surface; a suction box 17 is provided inside the roller 1 between the position in which the severing device 15 operates and the inlet 9 to the core feed channel; this box remains in a fixed position during rotation of the roller. The suction produced on the surface of the roller 1 causes the initial and final edges of the web material produced by tearing to adhere to the first roller 1.

The feed device 13 pushes a new core A to the inlet 9 of the feed channel. Synchronism between the severing device 15 and the action of the feed device 13 makes the core A rest against the surface of the first roller 1 at the inlet 9 of the feed channel when the final edge and the initial edge of the web material obtained by tearing have already moved beyond the inlet 9 of the channel defined by the rolling surface 8. The initial edge of the new log ceases to adhere to the first roller 1 when it moves beyond the zone of action of the suction sector 17 and consequently adheres to the core. A glue is applied to the core to hold the web material in order to start forming a new log. Alternatively other arrangements may be used to cause winding to commence. For example, the core may be provided with suction, or electrostatically charged, or yet again nozzles may be provided to redirect the initial edge of the web material so that it clings to the new core to form a first turn of the winding.

Driven by contact with the first winding roller 1 and with the rolling surface 8, the new core A with the web material that starts to wind around it travels along the feed channel rolling on the surface 8 at a speed that is half the peripheral speed of the first winding roller 1. Upon reaching the outlet 11 it travels through the nip 5 and enters the actual winding cradle, formed by the winding rollers 1, 3, 19 and where winding of the log is completed.

Once forming of the log has been completed the severing device 15 acts again to allow the log R to continue along the production line.

The aforesaid process to sever the web material, feed the new core, attach the initial free edge to the new core, form the log and unload the log from the winding cradle is schematically represented in the sequence in FIGS. 2 to 4.

Unloading of the log from the winding cradle is performed in a per se known way, for example by temporarily modifying the rotation speed of the winding rollers, in particular by reducing the speed of the winding roller 3 and/or increasing the speed of the winding roller 19.

Upstream of the severing device 15 a system may be provided to take up the slack in the web material caused by the effect of the device. A suction roller, a cylinder with a high friction coefficient, a suction box, an oscillating bar or any other suitable means may be used for this purpose.

Suction through the suction openings on the cylindrical shell of the winding roller 1 may be produced via a fan that may be made to operate constantly, providing a cutoff system on the suction line from the suction box 17 to the fan, to activate suction only when requested, that is during the phase to replace a completed log with a new tubular winding core A.

It is understood that the drawing purely shows a non-limiting practical embodiment of the invention, the forms and arrangements of which may vary without however departing from the scope of the concept underlying the invention. Any reference numerals in the attached claims are provided purely to facilitate reading in the light of the description hereinbefore and of the attached drawings and do not limit the scope of protection whatsoever.

The invention claimed is:

1. A rewinding machine to form logs of wound web material comprising: a first winding roller; a second winding roller; a nip defined between said first winding roller and said second winding roller, through which web material is fed; a surface, extending upstream of said nip in relation to a direction of feed of the web material and defining, with the first winding roller, a channel into which winding cores are fed, said channel having an inlet and an outlet; a core feeder to feed said winding cores towards said channel; a pinch member to pinch said web material between said pinch member and said first winding roller, wherein said pinch member is arranged upstream of said channel and arranged to periodically pinch said web material upstream of said channel, said pinch member having a speed lower than a peripheral speed of said first winding roller when pinching the web material;

said first winding roller having suction openings in a cylindrical surface thereof;

and a suction box is provided inside said first winding roller, arranged to retain a leading edge of said web material by suction through said suction openings and to transfer the leading edge to a new core introduced into said channel by said core feeder.

2. Rewinding machine according to claim 1, wherein said suction box extends inside said first winding roller to an intermediate position along said channel.

3. Rewinding machine according to claim 1, wherein said suction box extends from a position upstream of said pinch member to an intermediate position along said channel.

4. Rewinding machine according to claim 1, wherein said core feeder and said pinch member are controlled such that said pinch member tears said web material before said new core is brought into contact with the web material, said core feeder placing said new core into contact with said web material at a core and web contacting point, when said leading edge is located inside said channel downstream said core and web contacting point.

5. Rewinding machine as claimed in claim 1, wherein said suction openings are distributed over an entire circumferential extension of said first winding roller.

6. A method for producing logs of wound web material, comprising:

feeding web material along a feed path;

arranging a first winding roller and a second winding roller so as to define a nip therebetween, the web material being fed through said nip;

arranging a surface extending upstream of said nip, said surface and said first winding roller defining a channel into which winding cores are fed, said channel having an inlet and an outlet;

winding a first log around a first winding core;

upon termination of winding said first log, tearing the web material to form a web leading edge and a web trailing edge, said tearing being provided by arranging a pinch member acting on said web material upstream of said channel and periodically pinching said web material between said pinch member and said first winding roller, said pinch member having a speed lower than a peripheral speed of said first winding roller when pinching the web material, said tearing being downstream of said pinch member;

retaining by suction said leading edge on said first winding roller, while rotating said first winding roller;

inserting a new winding core into said channel;

bringing said new winding core into contact with said web material after said web material has been torn and upstream of said leading edge;

anchoring the leading edge to said new winding core and commencing winding of a second log therearound.

7. Method according to claim 6, further comprising releasing said leading edge from said winding roller by interrupting said suction at an intermediate position along said channel and causing said leading edge to be anchored to said core.

8. Method according to claim 6, further comprising applying glue to said core and gluing said web material to said core.

* * * * *